US009014579B2

(12) United States Patent
Honda

(10) Patent No.: US 9,014,579 B2
(45) Date of Patent: Apr. 21, 2015

(54) IMAGE FORMING APPARATUS

(71) Applicant: Oki Data Corporation, Tokyo (JP)

(72) Inventor: Noriyuki Honda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/156,588

(22) Filed: Jan. 16, 2014

(65) Prior Publication Data

US 2014/0199087 A1 Jul. 17, 2014

(30) Foreign Application Priority Data

Jan. 17, 2013 (JP) ..... 2013-006552

(51) Int. Cl.
*G03G 15/00* (2006.01)

(52) U.S. Cl.
CPC ..... *G03G 15/6585* (2013.01)

(58) Field of Classification Search
CPC ..... G03G 15/6585; G03G 2215/00805; G03G 2215/0081
USPC ..... 399/40, 184
See application file for complete search history.

(56) References Cited

U.S. PATENT DOCUMENTS

2012/0134696 A1* 5/2012 Kobayashi et al. ..... 399/54

FOREIGN PATENT DOCUMENTS

JP 2007-322819 A 12/2007

* cited by examiner

*Primary Examiner* — Gregory H Curran
(74) *Attorney, Agent, or Firm* — Muncy, Geissler, Olds & Lowe, P.C.

(57) ABSTRACT

An image forming apparatus includes an image forming part that forms an image on a print medium with a color colorant, a clear coat agent application part that applies a clear coat agent to the print medium passed through the image forming part, and a clear coat agent application amount determination part that determines an application amount of the clear coat agent.

11 Claims, 12 Drawing Sheets

*Fig. 12*
| Object Type | Text Object | Graphic Object | Picture Object | Background Object |
|---|---|---|---|---|
| Application Amount of Clear Coat Agent [mg/cm$^2$] | 0.3 | 0.4 | 0.5 | 0.6 |
*Fig. 13A*
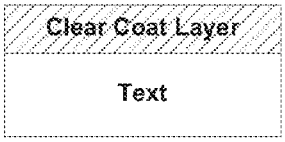
*Fig. 13B*
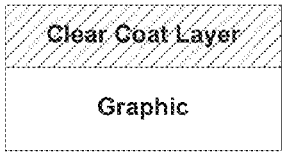
*Fig. 13C*
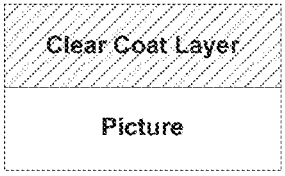
*Fig. 13D*
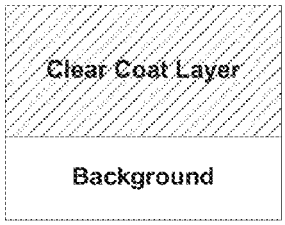

IMAGE FORMING APPARATUS

CROSS REFERENCE TO RELATED APPLICATION

The present application is related to, claims priority from and incorporates by reference Japanese Patent Application No. 2013-006552, filed on Jan. 17, 2013.

TECHNICAL FIELD

The present invention relates to an image forming apparatus that forms a clear coat layer on a background such as dot patterns and bar-codes.

BACKGROUND

A conventional image forming apparatus has a function that covers a visible image with a clear coat (transparent image) agent.

An object of the present invention is to reduce the consumption amount of the clear coat agent.

SUMMARY

An image forming apparatus disclosed in the application includes an image forming part that forms an image on a print medium with a color colorant, a clear coat agent application part that applies a clear coat agent to the print medium passed through the image forming part, and a clear coat agent application amount determination part that determines an application amount of the clear coat agent.

According to the above apparatus, an effect that the consumption amount of the clear coat agent is reduced is obtained.

BRIEF DESCRIPTION OF DRAWINGS

FIG. 12 is an application amount table.

FIGS. 13A-13D are sectional schematic views of printed matters when a clear coat layer is formed based on FIG. 12.

DETAILED DESCRIPTION OF EMBODIMENTS

Figure 1:
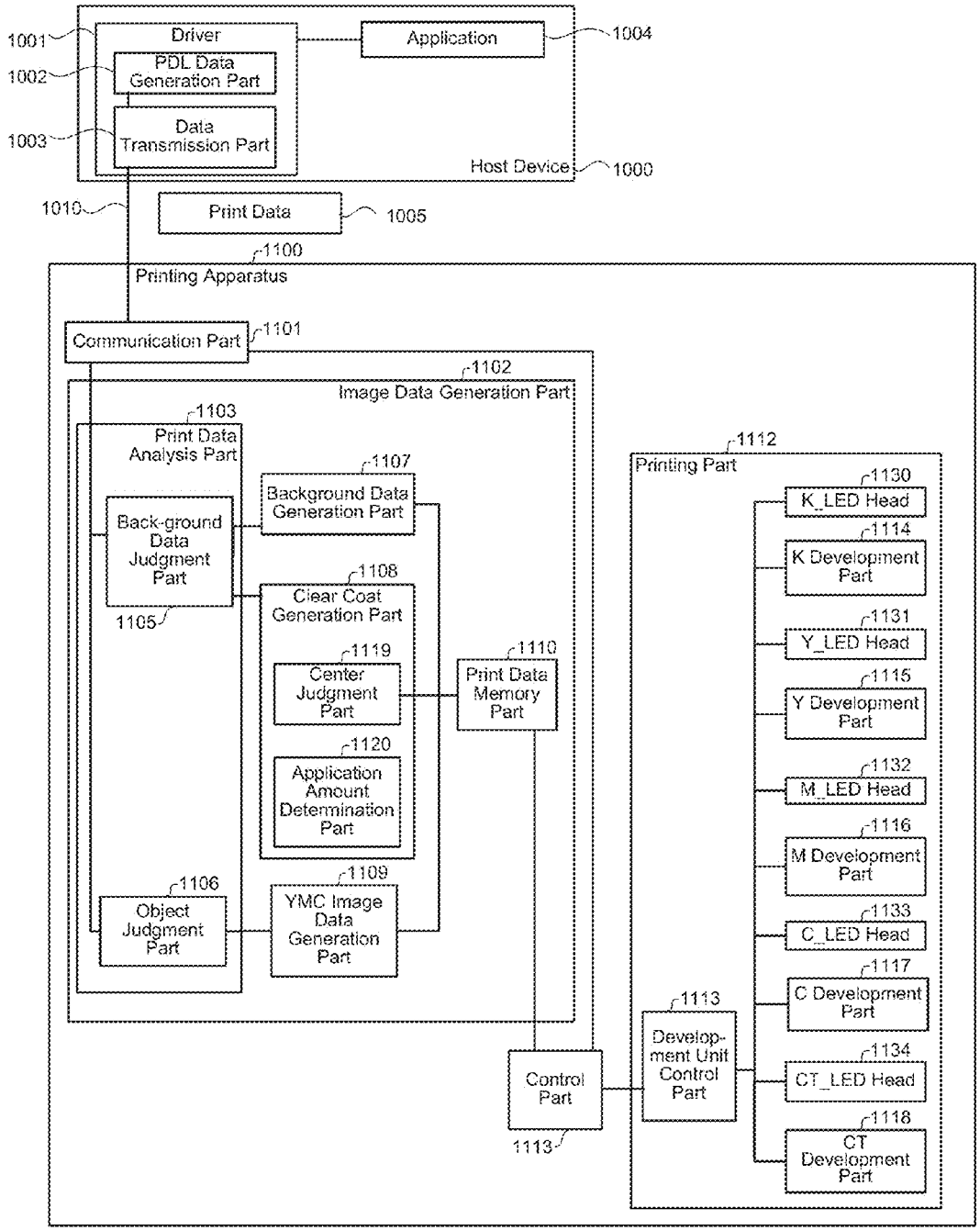
FIG. 1 is a block diagram that illustrates a configuration of a printing apparatus according to a first embodiment.

Hereinafter, embodiments of an image forming apparatus of the present invention are explained referring to the drawings.

First Embodiment

FIG. 1 is a block diagram that illustrates a configuration of a printing apparatus according to a first embodiment. In FIG. 1, an image forming system is configured from a host device 1000 and a printing apparatus 1100. The host device 1000 is connected to the printing apparatus 1100 by an electric connection unit 1010 such as a signal cable, and is a personal computer (PC) or the like that transmits designated print data to the printing apparatus 1100 upon the receipt of a print execution command by an user operation. Note, the electric connection unit 1010 may be an electric connection unit such as a wireless local area network (LAN).

The host device 1000 is provided with hardware, an application (software) 1004, and a driver (software) 1001. The hardware includes, for example, a control unit such as a central processing unit (CPU), a memory unit such as a random access memory (RAM) and a hard disk drive (HDD), an input unit such as a keyboard and a mouse, and a display unit such as a display. The application (software) 1004 creates output data configured from color image picture data and background picture data based on the information input by a user via the input unit.

The driver 1001 is provided with a page description language data generation part 1002 that generates print data 1005 from output data created by the application 1004 and a data transmission part 1003 that transmits print data 1005 to the printing apparatus 1100. The printing apparatus 1100 is an electrographic printer and is provided with a communication part 1101, a control part 1111, an image data generation part 1102, and a printing part 1112. The printing apparatus 1100 covers a background pattern (an image of background pattern) such as a dot pattern and a bar-code with a clear coat agent. When the background pattern is protected, a portion is covered with a smaller amount of clear coat agent, the portion being other than a portion that a reading device is more likely to contact and of which background pattern is more likely to be damaged or a portion of which background pattern is often read, so that the consumption amount of the clear coat agent is reduced.

Herein, the portion that the reading device is more likely to contact and of which background pattern is more likely to be damaged is a central part (or the area) of a background pattern area. For example, in view of human psychology, when the background pattern is read with the reading device, the central part of the background pattern area is designed to be read rather than an end portion thereof. Therefore, the central part and its vicinity often contact the reading device, and the frequency of being contacted by the reading device becomes less as getting close to an end portion from the central part.

In the present embodiment, a background pattern image formed by background image data is a pattern image formed with minute size dots as illustrated in FIGS. 6A-6E. In such pattern image, for example, a certain type of information or the like can be added by a combination of dots arranged in a predetermined position. Generally, GridMark (a registered trademark) technology and ANOTO (a registered trademark) and the like are used. The communication part 1101 connects the printing apparatus 1100 and the host device 1000 via the electric connection unit 1010 such as a communication cable, and performs transmission and receipt of data.

The control part 1111 is configured from a CPU or the like, and controls performance of the entire printing apparatus 1100 including the communication part 1101, the image data generation part 1102, and the printing part 1112 based on a control program (software) memorized in the memory part. The control part 1111 forwards the print data 1005 that the communication part 1101 receives from the host device 1000 to a print data analysis part 1103. Also, the control part 1111 gives a command of image formation to a development unit control part 1113 depending on image data stored in a print data memory part 1110.

The image data generation part 1102 generates K, Y, M, C, and CT print data from the print data 1005 received from the host device 1000, and converse to image data to form its image at a printing part 1112. The printing part 1112 prints images to a print medium (hereinafter, referred to as medium) based on image data of each of colors that configure K, Y, M, C, and CT print data generated by the image data generation part 1102. Here, K, Y, M, C, and CT print data is configured from image data of background (K) image data, Y image data, M image data, C image data, and clear coat (CT) image data. K represents black, Y represents yellow, M represents magenta, C represents cyan, and CT represents clear.

The image data generation part 1102 is provided with the print data analysis part 1103, a background data generation part 1107, a clear coat generation part 1108, an YMC image data generation part 1109, and the print data memory part 1110. The print data analysis part 1103 judges a type and area of each object of the print data 1005 consisting of a plurality of objects, and is provided with a background data judgment part 1105 and an object judgment part 1106. The print data analysis part 1103 analyses the print data 1005 that is receipt data received via the communication part 1101, and forwards image data to conversion parts of the background data generation part 1107, the clear coat generation part 1108, and the YMC image data generation part 1109.

The background data judgment part 1105 selects only data that contains background data from the receipt data received via the communication part 1101 and analyses it, and then forwards the analyzed data to the background data generation part 1107 and the clear coat generation part 1108. The object judgment part 1106 selects object data other than background from the receipt data received via the communication part 1101 and analyses it, and then forwards the analyzed data to the YMC image data generation part 1109. The background data generation part 1107 performs an edit and expand process based on data judged by the background data judgment part 1105, and generates picture data and print information of the background image data (hereinafter, also referred to as "background data.")

The clear coat generation part 1108 is configured from a center judgment part 1119 as a clear coat agent print area center judgment part and an application amount determination part 1120 as a clear coat agent application amount determination part. The clear coat generation part 1108 determines an area to print with a clear coat agent based on data (type of object) judged by the background data judgment part 1105 of the print data analysis part 1103. After that, the center judgment part 1119 judges a central part of the area to print with the clear coat agent, and the application amount determination part 1120 performs a gradation process to gradually reduce the amount of the clear coat agent from the central part to the outside (end portion). The application amount of the clear coat agent to cover the background data formed on the medium 207 is determined, and picture data and print information of a protective data portion that the background data is covered is generated. In other words, the application amount determination part 1120 determines the application amount of the clear coat agent of the center portion of the background data to be smaller than the application amount of the clear coat agent of the end portion.

The YMC image data generation part 1109 performs an edit and expand process based on data judged by the object judgment part 1106, and picture data and print information of a text part, graphic part, and picture part is generated. The print data memory part 1110 memorizes the picture data and print information as image data, the picture data and print information being generated by the background data generation part 1107, the clear coat generation part 1108, and the YMC image data generation part 1109. Next, explanation of the printing part 1112 is given referring to the schematic side view, which is FIG. 2, that illustrates the configuration of the printing device according to the first embodiment.

The printing part 1112 includes the development unit control part 1113, a K development part 1114 and a K_LED (light emitting diode) head 1130 that are designed for K color, a Y development part 1115 and a Y_LED head 1131 that are designed for Y color, a M development part 1116 and a M_LED head 1132 that are designed for M color, a C development part 1117 and a C_LED head 1133 that are designed for C color, and a CT development part 1118 and a CT_LED head 1134 that are designed for CT color. From the upstream side to the downstream side in the carrying direction of the print medium 207 as the arrow A indicates in FIG. 2, the K development part 1114 and the K_LED head 1130, the Y development part 1115 and the Y_LED head 1131, the M development part 1116 and the M_LED head 1132, the C development part 1117 and the C_LED head 1133, and the CT development part 1118 and the CT_LED head 1134 are arranged in this order.

The K development part 1114 (the K_LED head 1130) as a background formation part forms a background on the print medium. The Y development part 1115 (the Y_LED head 1131), the M development part 1116 (the M_LED head 1132), and the C development part 1117 (the C_LED head 1133), which are as image formation parts, form an image of color colorant on the print medium. The CT development part 1118 (the CT_LED head 1134) as a clear coat agent application part applies clear coat agent to the print medium that has passed through the K development part 1114, the Y development part 1115, the M development part 1116, and the C development part 1117.

The development unit control part 1113 generally controls the K development part 1114, the Y development part 1115, the M development part 1116, the C development part 1117, and the CT development part 1118 based on the control of the control part 1111. The K development part 1114, the Y development part 1115, the M development part 1116, the C development part 1117, and the CT development part 1118 are development parts respectively provided for the colors of the printing part 1112. Note, the development parts have the same configuration except for the difference of the image colors to form, so the explanation of the configuration is given using the K development part 1114 as their representative.

Figure 2:
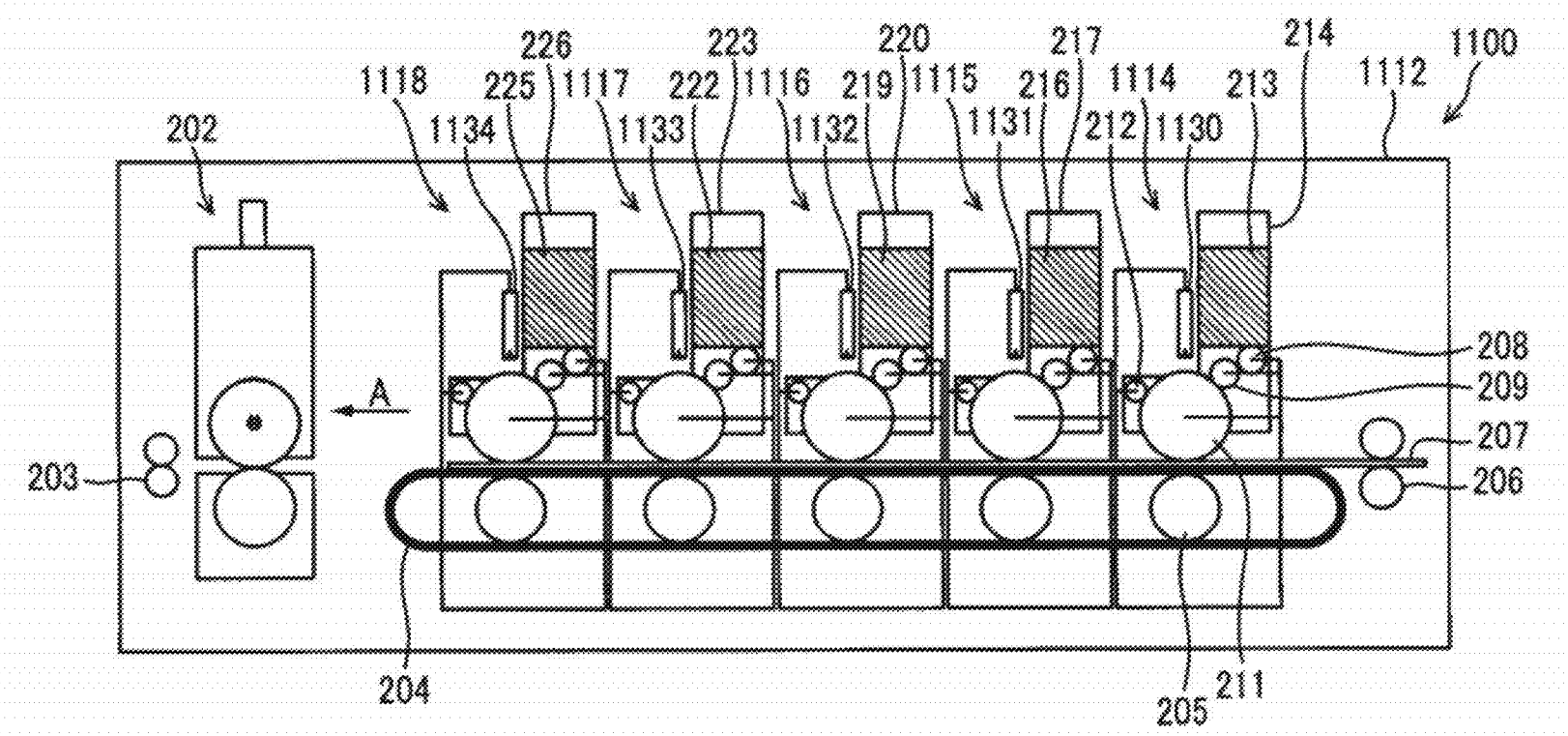
FIG. 2 is a schematic side view that illustrates the configuration of the printing apparatus according to the first embodiment.

As illustrated in FIG. 2, the K development part 1114 includes a charge roller 212, a photosensitive drum 211, the K_LED head 1130, K developer 213, a developer supply roller 208, and a development roller 209. The charge roller 212 charges the photosensitive drum 211. The photosensitive drum 211 is charged by the charge roller 212 and an electrostatic latent image is formed on the photosensitive drum 211 by an exposure unit. The K_LED head 1130 is arranged to face the photosensitive drum 211, and works as the exposure unit that exposes the surface of the photosensitive drum 211 by radiating light based on a print image. The K developer 213 is used in the present embodiment, and uses toner as black developer. The developer supply roller 208 carries the K developer 213 contained in a developer container 214. The development roller 209 is arranged to face the photosensitive drum 211, and develops an electrostatic latent image as a developer image by supplying the K developer 213 supplied from the developer supply roller 208 to the photosensitive drum 211.

Note, a developer container 217 of the Y development part 1115 contains Y developer 216, a developer container 220 of the M development part 1116 contains M developer 219, a developer container 223 of the C development part 1117 contains C developer 222, and a developer container 226 of the CT development part 1118 contains CT developer 225. In the present embodiment, for the K developer 213 as first developer, carbon black is used that is black pigment and has a property that absorbs near infrared light. Also, for the Y developer 216, the M developer 219, and the C developer 222 that are color developer as second developer that is layered on a developer layer of the first developer on the medium 207 and for the CT developer 225 that is clear coat developer, pigment that has a property that permeates near infrared light is used.

The printing part 1112 includes a pair of sheet feeding rollers 206, a transferring belt 204, a fuser 202, and a pair of sheet ejection rollers 203 as members that configures the carrying path of the medium 207. The pair of sheet feeding rollers 206 feeds sheets from a medium supply part. The transferring belt 204 carries the medium 207 fed from the pair of sheet feeding rollers, and a transferring roller 205 transfer a developer image formed in the development part of the corresponding color, and the transferring roller 205 that is arranged to face the photosensitive drum of the corresponding development part transfers a developer image formed in the development part of each color to the medium 207. The fuser 202 fuses the developer image transferred to the medium 207 to the medium 207 by applying heat and pressure. The pair of sheet ejection rollers 203 ejects the medium 207 on which the developer image is fused by the fuser 202 to the outside of the printing apparatus 1100. In the process of being carried by the transferring belt 204, the developer images formed in the above-described development parts are sequentially transferred to the medium 207 fed via the pair of sheet feeding rollers 206 from the medium supply part.

Note, in the present embodiment, from the upstream side to the downstream side in the carrying direction of the medium 207 indicated by the arrow A in FIG. 2, a first developer image formed in the K development part 1114 as a first development part, second developer images respectively formed in the Y development part 1115, the M development part 1116, and the C development part 1117 as a second development part, and a CT developer image formed in the CT development part 1118 are sequentially transferred to the medium 207. After that the developer images formed in the development parts are transferred to the medium 207, the fuser 202 fuses the developer images by applying heat and pressure to the medium 207. The medium 207 on which the development images are fused is ejected to the outside of the printing apparatus 1100 by the pair of sheet ejection rollers 203.

A function of the above-described configuration is explained. At first, a function of the image forming system is explained using FIG. 1. In response to a print start instruction by a user operation, the application 1004 in the host device 1000 generates a spool file based on created color image picture data and background image picture data and outputs the generated spool file to the driver 1001. Herein, the spool file is intermediate data of print data that the application 1004 sends to the driver 1001.

In response to the input of the spool file output from the application 1004, the PDL data generation part 1002 of the driver 1001 generates PDL data described in a program language to instruct the printing apparatus 1100 to draw. Also, the PDL data generation part 1002 generates print job data that includes background image data and color print data. Herein, an identifier is given to the print job data to identify the color print data and the background image data.

Figure 4:
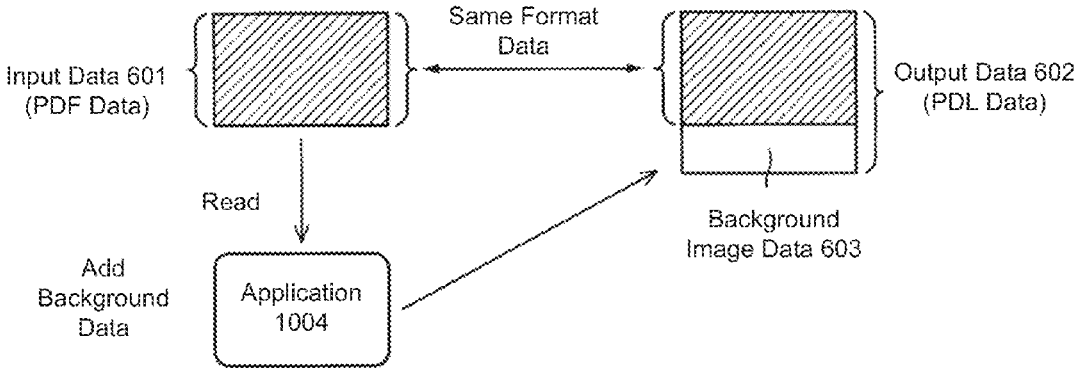
FIG. 4 is an explanatory view of a method of creating background pattern image data according to the first embodiment.

Herein, an explanation of a method of adding and creating background image data (background data) is given using a method of GridMark as an example and referring to FIG. 4 that is the explanatory view of a method of creating background pattern image data according to the first embodiment. Input data 601 is data that is to be read by the application 1004, that is before adding the background image data, and that is normally portable document format (PDF) in the case of GridMark.

In the application 1004, after reading the input data 601, by an user operation, the background image data 603 is added to the read input data 601 (PDF data), and output data 602 is created. Also, in the application 1004, without reading the input data 601, it is also possible to newly expand blank data in the application 1004, add the background image data 603 to the data, and create the output data 602.

When all of the background image data is added to the input data 601 and creation of the output data 602 is completed, the application 1004 transmits the created output data to the driver 1001. The output data 602 is configured of a front part (slanted line part in the figure) and a rear part. The front part (slanted line part in the figure) is data in the format that is the same type as the input data 601 is. The rear part is data that the background image data 603 is newly added. The data transmission part 1003 transmits the print data 1005 to the communication part 1101 of the printing apparatus 1100, the print data 1005 being generated by the PDL data generation part based on the output data 602.

Figure 3:
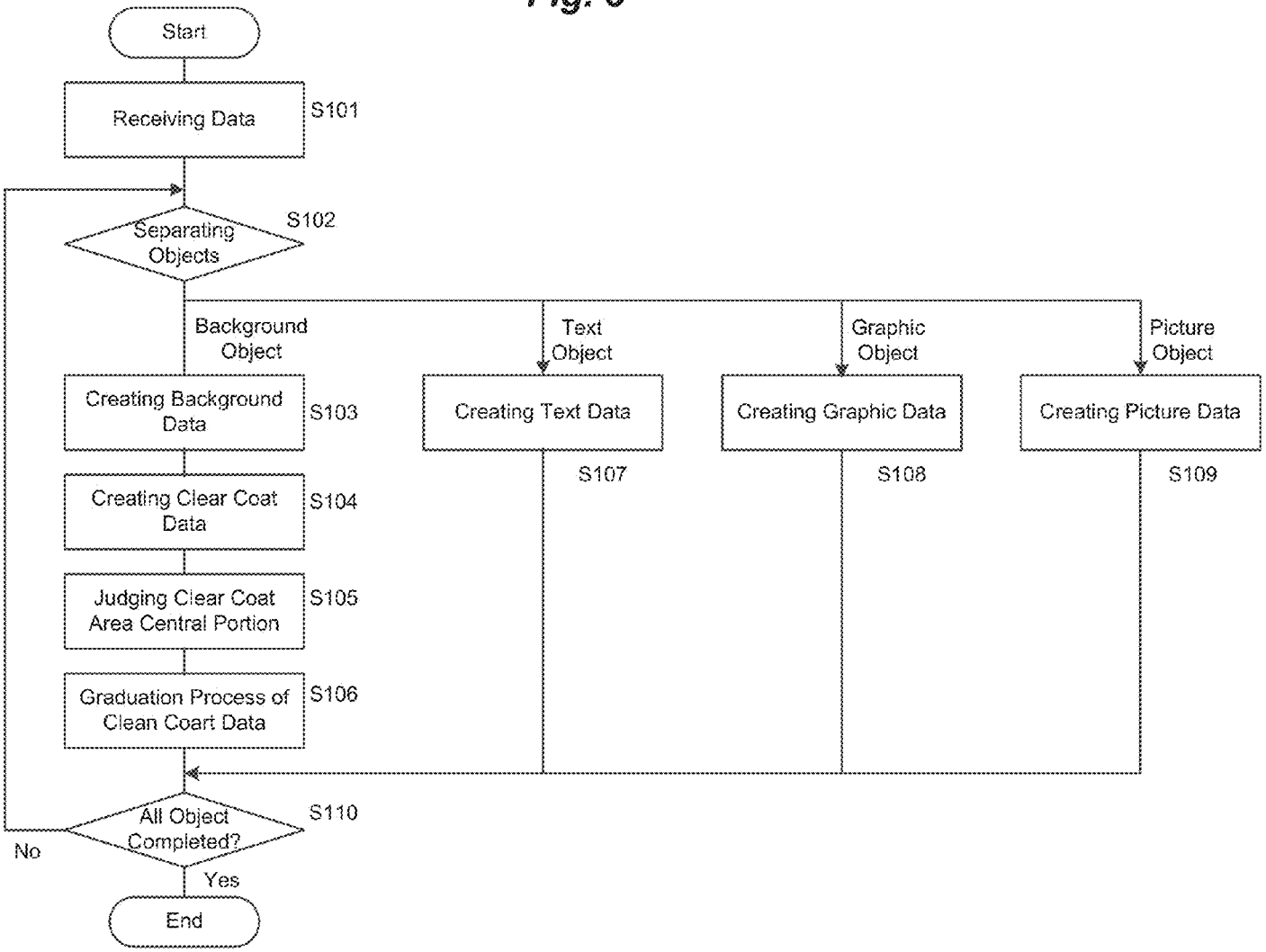
FIG. 3 is a flow diagram that illustrates a flow of a image data generation process according to the first embodiment.

Next, referring to FIG. 1, an image data generation process that the image data generation part 1102 of the printing apparatus 1100 performs is explained, following steps in a flow diagram of FIG. 3 that describes the image data generation process according to the first embodiment. Herein, the steps are indicated by S in the figure. S101: Upon receipt of the print data 1005 transmitted from the data transmission part 1003 of the host device 1000 via the communication part 1101, the control part 1111 of the printing apparatus 1100 forwards print data 1005 to the print data analysis part 1103 of the image data generation part 1102.

S102: The print data analysis part 1103 analyzes the received print data 1005; the background data judgment part 1105 judges whether the data is background data (background object) or not, and the object judgment part 1106 judges whether the data is text data (text object), graphic data (graphic object), or picture data (picture object); and the data is separated by each object. In the print data analysis part 1103, when a separated object is judged a background object, the process moves into S103; when a separated object is judge a text object, the process moves into S107; when a separated object is judge a graphic object, the process moves into S108; and when a separated object is judged as a picture object, the process moves into S109. In the embodiment, the objects are comprised with four elements that are background, text, graphic and picture. It is practical to use not all but some of the above elements. It is also practical to include an element other than the four elements.

S103: The background generation part 1107 creates raster data, print information and the like of background data based on the separated object; and those are stored in a display list of the print data memory part 1110. Herein, the display list means an intermediate buffer of a memory part in which an analysis result of receipt data is stored and is an information management table that information regarding shapes of images, positions of images, printing colors, and drawing data, drawing patterns, expansion rules and the like of letters, drawings, pictures and the like are written.

S104: The clear coat generation part 1108 performs a clear coat data creation process that determines a clear coat area that the clear coat agent is applied. Generally, an entire drawing area of the background data created at S103 is set as a basic area, and an area that contains the basic area and an outside area that is a predetermined size of area directly outside the basic area is set as a printing area. However, in the present embodiment, the clear coat generation part 1108 can arbitrarily determine the size of the outside area with respect to the basic area, and creates clear coat data in which the area that contains the basic area and the outside area is set as one new clear coat agent drawing object.

Figure 5:
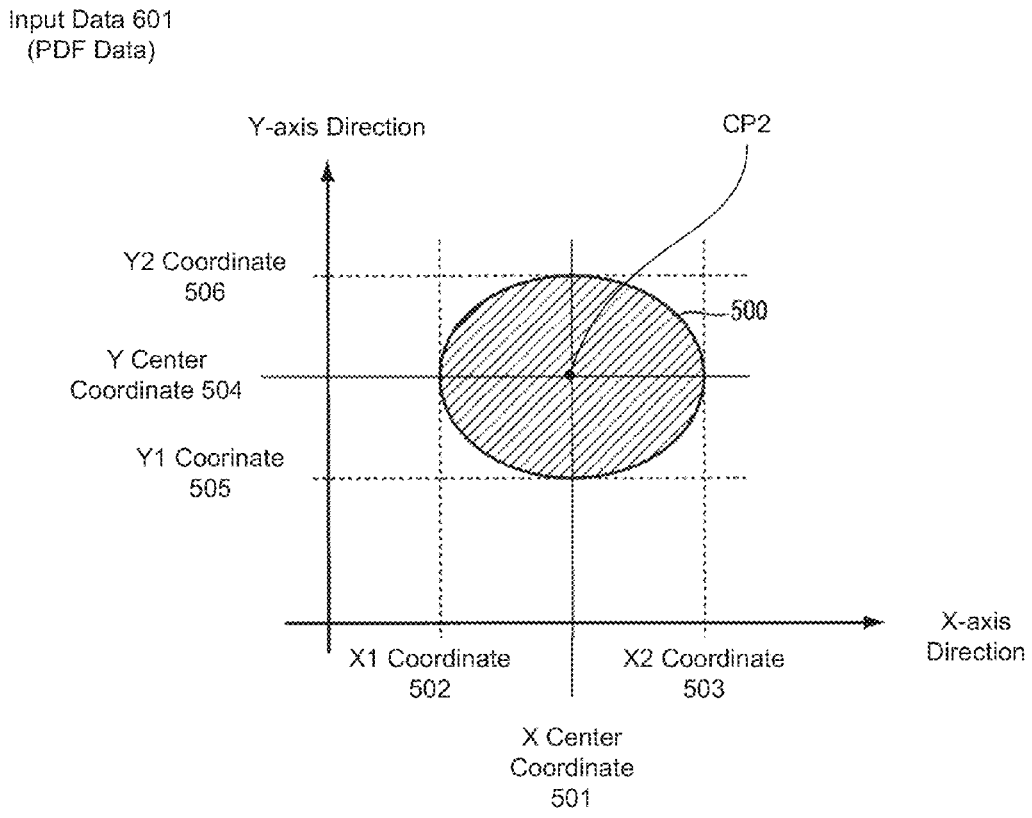
FIG. 5 is an explanatory view of a clear coat area center coordinate calculation process according to the first embodiment.

S105: The center judgment part 1119 judges a central part of a clear coat area and performs a clear coat area center coordinate calculation process to determine the clear coat area. Herein, the clear coat area center coordinate calculation process that the center judgment part 1119 performs is explained based on FIG. 5 that is the explanatory view of the clear coat area center coordinate calculation process according to the first embodiment. First, the center judgment part 1119 obtains a left end X1 coordinate 502 and a right end X2 coordinate 503 of a clear coat area 500 with respect to the X axis direction and then obtains a X center coordinate 501 by the X center coordinate=(left end X1 coordinate+right end X2 coordinate)/2.

Next, the center judgment part 1119 obtains a bottom end Y1 coordinate 505 and an upper end Y2 coordinate 506 of the clear coat area 500 and then obtains a Y center coordinate 504 by the Y center coordinate=(bottom end Y1 coordinate+upper end Y2 coordinate)/2. As described above, the center judgment part 1119 calculates the center coordinates (the X center coordinates 501 and the Y center coordinates 504) of the clear coat area.

S106: The application amount determination part 1120 performs a gradation process of clear coat data. The application amount determination part 1120 performs the gradation process onto the drawing area of the clear coat data created at S104 from the center coordinates (the X center coordinate 501 and the Y center coordinate 504) to the left end X1 coordinate 502, the right end X2 coordinate 503, the bottom end Y1 coordinate 505, and the upper end Y2 coordinate 506 of the clear coat area of the background area obtained at S105 illustrated in FIG. 5; creates raster data of the clear coat agent, print information, and the like and stores in the display list of the print data memory part 1110; and the process moves into S110.

Figure 6A:
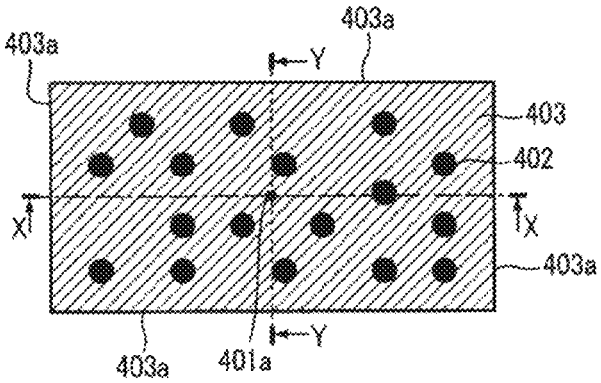
FIGS. 6A-6E are explanatory views of a gradation process according to the first embodiment.
Figure 6B:
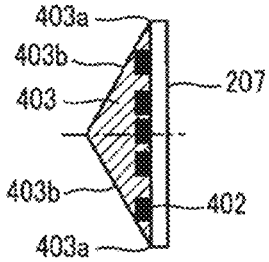
Figure 6C:
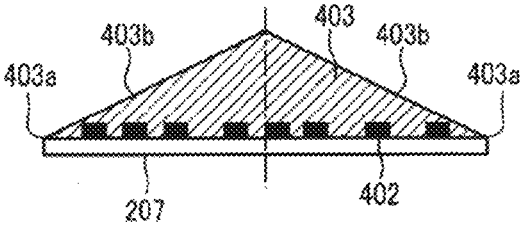
Figure 6D:
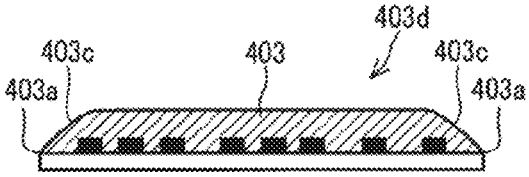
Figure 6E:
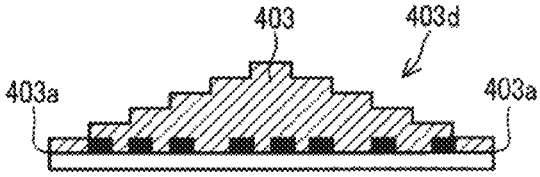

Herein, the gradation process is explained based on FIGS. 6A-6E that are explanatory views of the gradation process according to the first embodiment. Note, there are various methods for the graduation process depending on the type and purpose of background data; however, three types of methods are explained using FIGS. 6A-6E in the present embodiment. FIGS. 6A-6E are layout views of background codes as background data by a technology such as GridMark and the like that reads small background codes. On an upper surface of a medium 207, background codes 402 in a dot shape are arranged, and clear coat agent 403 is printed so as to cover the background codes 402. FIG. 6A is a top view; FIG. 6B is a Y-Y cross view of FIG. 6A; FIG. 6C is a X-X cross view of FIG. 6A; and FIG. 6D and FIG. 6E are X-X cross views of FIG. 6A.

FIGS. 6A-6C show a method that an application amount of the clear coat agent is gradually reduced from a center coordinate 401*a* as a central part toward the outside (end portion 403*a*) of the clear coat area so as to form an inclined surface 403*b* (sections have linear shapes as illustrated in FIGS. 6B and 6C). Also, FIG. 6D shows a method that an application amount of the clear coat agent is gradually reduced from the center coordinate 401*a* as the central part toward the outside (end portion 403*a*) of the clear coat area so as to form a curved surface (convex surface) 403*c* in the vicinity of the end portion of the outside of the clear coat area.

Also, FIG. 6E shows a method that an application amount of the clear coat agent is stepwisely (cross section has a step shape 403*d*) and gradually reduced from the center coordinate 401*a* toward the outside (end portion 403*a*) of the clear coat area. Note, because the application amount of the clear coat agent is gradually reduced to have a curved shape in the methods illustrated in FIGS. 6A-6D, there is no unevenness on the surface of the clear coat agent, and the clear coat agent is viewed smooth. On the other hand, because the application amount of the clear coat agent is stepwisely and gradually reduced in the method illustrated in FIG. 6E, there are advantages that the gradation process is simplified and that the process time is short.

S107: The YMC image data generation part 1109 creates raster data of a text, print information, and the like based on a separated object and stores in the display list of the print data memory part 1110; and then the process moves into S110. S108: The YMC image data generation part 1109 creates raster data of a graphic, print information, and the like based on a separated object and stores in the display list of the print data memory part 1110; and then the process moves into S110.

S109: The YMC image data generation part 1109 creates raster data of an image, print information, and the like based on a separated object and stores in the display list of the print data memory part 1110; and then the process moves into S110. S110: The control part 1111 judges whether analysis of all objects of the print data 1005 received from the host device 1000 via the communication part 1101 is completed; the process moves into S102 again and analysis of the print data 1005 is performed again when the control part 1111 judges that the analysis is not completed; and all process ends when the control part 1111 judges that all analysis is completed.

When image data is generated by the image data generation part 1102 of the printing apparatus 1100, the control part 1111 instructs the development unit control part 1113 of the printing part 1112 to perform image formation based on each image data stored in the display list in the print data memory part 1110. Upon receipt of the instruction, the development unit control part 1113 controls the K development part 1114, the Y development part 1115, the M development part 1116, the C development part 1117 and the CT development part 1118, and the K_LED head 1130, the Y_LED head 1131, the M_LED head 1132, the C_LED head 1133, and the CT_LED head 1134 such that image formation of a background data image is performed in the K development part 1114, image formation of a Y image of YMC image data is performed in the Y development part 1115, image formation of a M image of the YMC image data is performed in the M development part 1116, image formation of a C image of the YMC image data is performed in the C development part 1117, and image formation of a clear coat image of clear coat image data is performed in the CT development part 1118.

Image formation operation of the printing apparatus 1100 is explained referring to FIG. 1 and FIG. 2. Upon receipt of a print start instruction from the control part 1111, the developer unit control part 1113 controls a high voltage power source (not illustrated) to add a negative voltage to a charge roller 212 in the K development part 1114 and to charge the surface of the photosensitive drum 211 to be negative. The development unit control part 1113 that has charged the surface of the photosensitive drum 211 to be negative controls radiation of the K_LED head 1130 such that the K_LED head 1130 radiates light based on the background image data to the surface of the photosensitive drum 211. The photosensitive drum 211 receives light radiated from the K_LED head 1130 as rotating, and as the result charge amount of negative charge of only a portion that receives the light, that is, a portion that the background pattern image based on the background image data is formed, is reduced and an electrostatic latent image is formed.

On the other hand, negative charge is added to the K developer 213 contained in the developer container 214 of the K development part 1114 in a process of being carried to the photosensitive drum 211 by the developer supply roller 208 and the development roller 209, and the K developer 213 is applied only to a portion of the surface of the photosensitive drum 211 which the charge amount of negative charge is reduced. Simultaneously with this operation, the control part 1111 outputs the print start instruction to a sheet supply and carrying control part and a rollers driving control part, etc, and an operation that carries the medium 207 to the printing part 1112 starts.

When the medium 207 carried by the pair of sheet feeding rollers 206 reaches the K development part 1114, due to the function of electric field generated by a positive voltage applied to the transferring roller 205 arranged inside the transferring belt 204 by the high voltage power source (not illustrated), the background pattern image formed by the K developer 213 is transferred from the surface of the photosensitive drum 211 to the surface of the medium 207.

In the same manner, the development unit control part 1113 controls the Y_LED head 1131, the M_LED head 1132, the C_LED head 1133, and the CT_LED head 1134 based on information of the YMC image data and the Y image data, the M image data, the C image data, and the CT image data of the clear coat image. On the surface of the photosensitive drum, a developer image using the Y developer 216, a developer image using the M developer 219, a developer image using the C developer, a developer image using the CT developer 225 are respectively formed in the Y development part 1115, the M development part 1116, the C development part 1117, and the CT development part 1118. And the images are sequentially transferred to the medium 207 carried by the transferring belt 204. At this time, for the Y developer 216, the M developer 219, the C developer 222, and the CT developer 225, pigments that light with a predetermined wavelength (in the present embodiment, near infrared light) penetrates are used.

On the medium 207 carried by the transferring belt 204 in the direction indicated by the arrow A in FIG. 2, the developer images are fused when heat and pressure are given by the fuser 202. The medium 207 on which the developer images are fused is ejected by the pair of sheet ejection rollers 203 to the outside of the printing apparatus 1100, and then the image formation operation is completed. When the image formation operation is completed by the printing apparatus 1100, as illustrated in FIGS. 6A-6E, the developer images are formed on the medium 207.

As described above, because an image of the clear coat agent 403 is formed on an upper layer part of the background codes 402 with the CT developer 225 in the CT development unit 1118 so as to cover an image of the background codes 402 formed in the K development part 1114 with the K developer 213, the background codes 402 can be protected. Also a YMC image formed with the Y developer 216 in the Y development part 1115, formed with the M developer 219 in the M development part 1116, and formed with the C developer 222 in the C development part 1117 might be on the image of the background code 402 formed with the K developer 213. In that case, the YMC image is also covered by the clear coat agent 403 and can be protected.

In the present embodiment, a control operation of image formation whose feature is to adjust the application amount of clear coat agent generated in the CT development part 1118 with the CT developer 225 is performed. The application amount of clear coat agent is adjusted by adjusting light amount of the CT_LED head 1134. The application amount can be increased by increasing an exposure amount, and the application amount can be decreased by decreasing an exposure amount. Therefore, the application amount of clear coat agent can be adjusted.

As described above, in the present embodiment, a portion that damage of the background data is severe and a portion that prevention of damage of the background data is necessary are covered with a normal application amount of clear coat agent, and a portion that damage of the background data rarely occurs and a portion that damage of the background data doesn't affect are covered with an application amount of clear coat agent that is smaller than the normal application amount. As the result, the consumption of the clear coat agent can be reduced.

As described above, in the first embodiment, the application amount of clear coat agent to cover an area other than an area that the background pattern is more likely to be damaged because a reading device and the like often contacts the background data image or an area that the background pattern is frequently read is set to be smaller than the normal application amount. As a result, an effect that the consumption of the clear coat agent can be reduced can be obtained. Also, by a gradation effect that the application amount of clear coat agent is gradually reduced from the central part of the background data to the end portion, an effect that a border between a portion covered with the clear coat agent and a portion not covered becomes non-visible can be obtained.

Second Embodiment

In the first embodiment, the application amount of clear coat agent is arranged to be gradually reduced from the center of the background data as a base point toward the outside. This is an effective method for the background data (background pattern) that is read with points as GridMark and the like. However, in background data that is read with lines such as conventional barcodes (one dimensional barcodes), the background data (background pattern) may be damaged and may not be read because the application amount of clear coat agent on the end portion of the background data is small. The second embodiment is arranged to be effective for the background data (background pattern) read with lines and to reduce the consumption amount of the clear coat agent.

Figure 7:
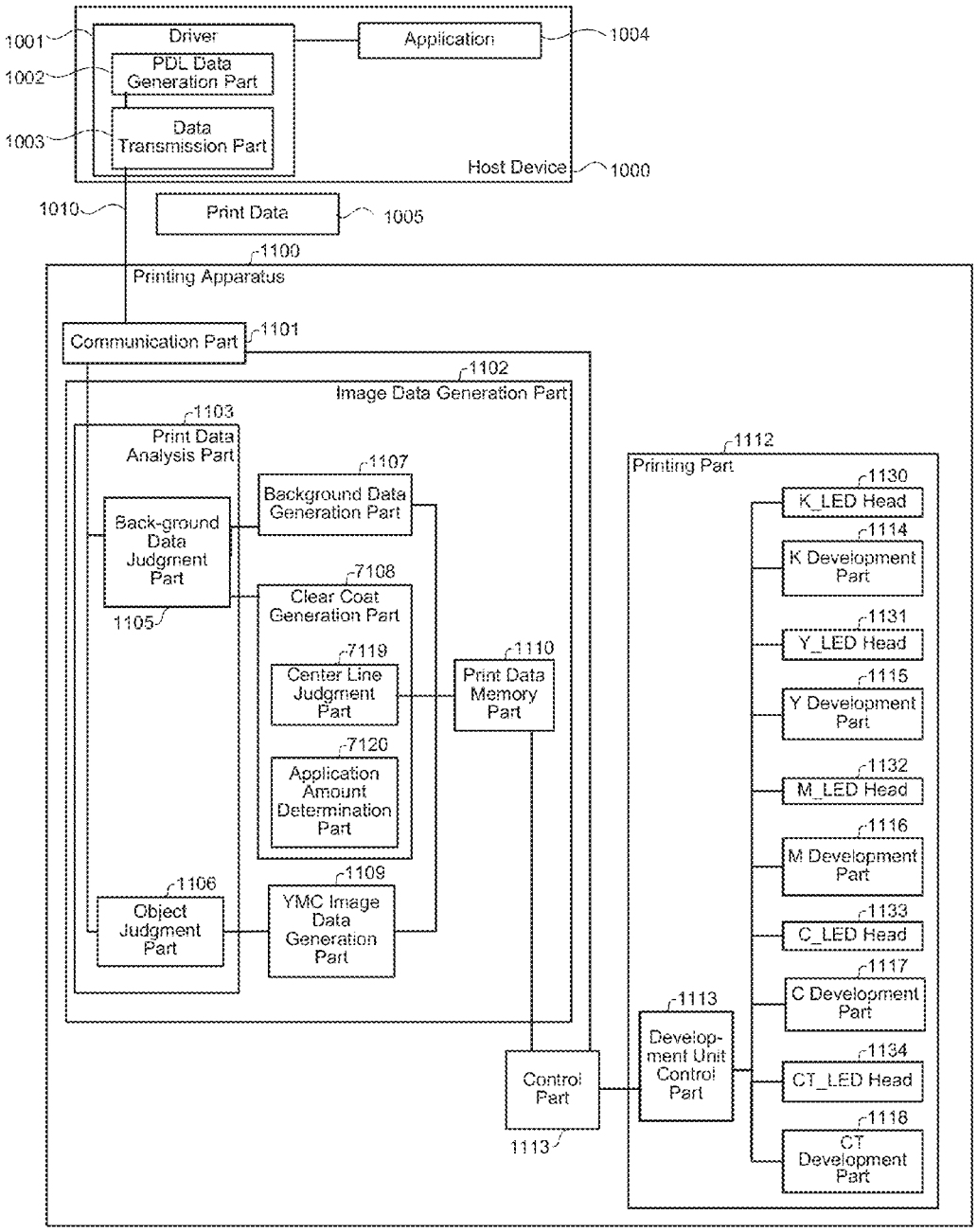
FIG. 7 is a block diagram that illustrates a configuration of a printing apparatus according to a second embodiment.

FIG. 7 is a block diagram that illustrates a configuration of a printing apparatus according to a second embodiment.

Figure 9A:
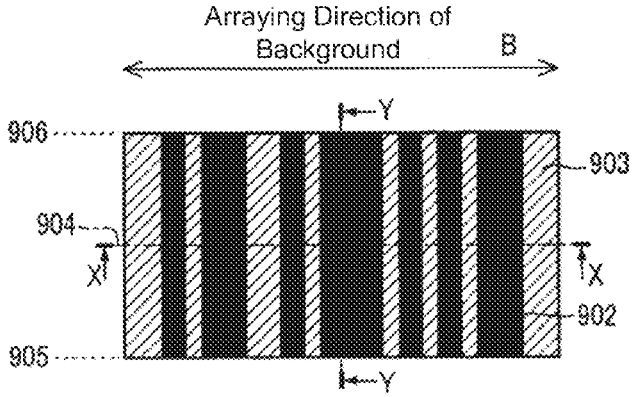
FIGS. 9A-9C are explanatory views of a background pattern code according to the second embodiment.
Figure 9B:
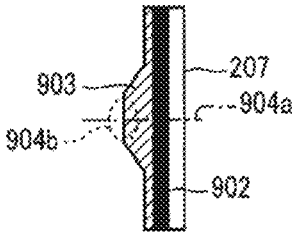
Figure 9C:
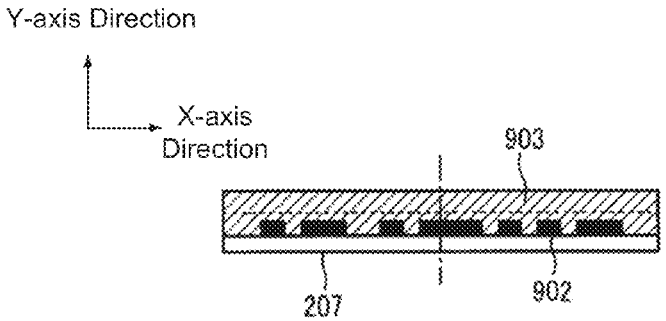

Note, the same reference numbers are given to the parts that are the same as those of the above-described first embodiment, and explanation of those are omitted. Also, in the present embodiment, a background pattern image represented by background image data is a conventional one dimensional barcode as illustrated in FIGS. 9A-9C. In FIG. 7, the image data generation part 1102 includes the print data analysis part 1103, the background data generation part 1107, a clear coat generation part 7108, the YMC image data generation part 1109, and the print data memory part 1110.

The print data analysis part 1103 includes the background data judgment part 1105 and the object judgment part 1106, analyzes the print data 1005 that is the receipt data received via the communication part 1101, and forwards the image data to the conversion parts of the background data generation part 1107, the clear coat generation part 7108, and the YMC image data generation part 1109. The background data judgment part 1105 selects only data that contains only background from the receipt data received via the communication part 1101 and analyses it, and then forwards the analyzed data to the background data generation part 1107 and the clear coat generation part 7108.

The object judgment part 1106 selects object data other than background from the receipt data received via the communication part 1101 and analyses it, and then forwards the analyzed data to the YMC image data generation part 1109. The background data generation part 1107 performs an edit and expand process based on data judged by the background data judgment part 1105, and generates picture data and print information of the background image data.

The clear coat generation part 7108 is configured from a center line judgment part 7119 as a clear coat agent print area center judgment part and an application amount determination part 7120 as a clear coat agent application amount determination part. The clear coat generation part 7108 determines an area to print with a clear coat agent based on data judged by the background data judgment part 1105. After that, for example, as illustrated in FIGS. 9A-9C, the center line judgment part 7119 judges a central part (center line 904) of the area to print with the clear coat agent in the direction orthogonal to the reading direction of the background data, and the application amount determination part 7120 performs a gradation process to gradually reduce the application amount of the clear coat agent from the central part to the end portion. The application amount of the clear coat agent to cover the background data formed on the medium 207 is determined, and picture data and print information of a protective data portion that the background data is covered is generated. In other words, the application amount determination part 7120 determines the application amount of the clear coat agent of the center portion of the background data to be smaller than the application amount of the clear coat agent of the end portion.

The YMC image data generation part 1109 performs an edit and expand process based on data judged by the object judgment part 1106, and picture data and print information of a text part, graphic part, and picture part is generated. The print data memory part 1110 memorizes the picture data and print information as image data, the picture data and print information being generated by the background data generation part 1107, the clear coat generation part 7108, and the YMC image data generation part 1109.

A function of the above-described configuration is explained. At first, a function of the image forming system is explained using FIG. 7. In response to a print start instruction by an user operation, the application 1004 in the host device 1000 generates a spool file based on the created color image picture data and background image picture data and outputs the generated spool file to the driver 1001. Herein, the spool file is intermediate data of print data that the application 1004 sends to the driver 1001.

In response to the input of the spool file output from the application 1004, the PDL data generation part 1002 of the driver 1001 generates PDL data described in a program language to instruct the printing apparatus 1100 to draw. Also, the PDL data generation part 1002 generates print job data that includes background image data and color print data. Herein, an identifier is given to the print job data to identify the color print data and the background image data. To the background image data, an identifier to identify the reading direction is given. The data transmission part 1003 transmits the print data 1005 generated by the PDL data generation part based on the output data 602 to the communication part 1101 of the printing apparatus 1100.

Figure 8:
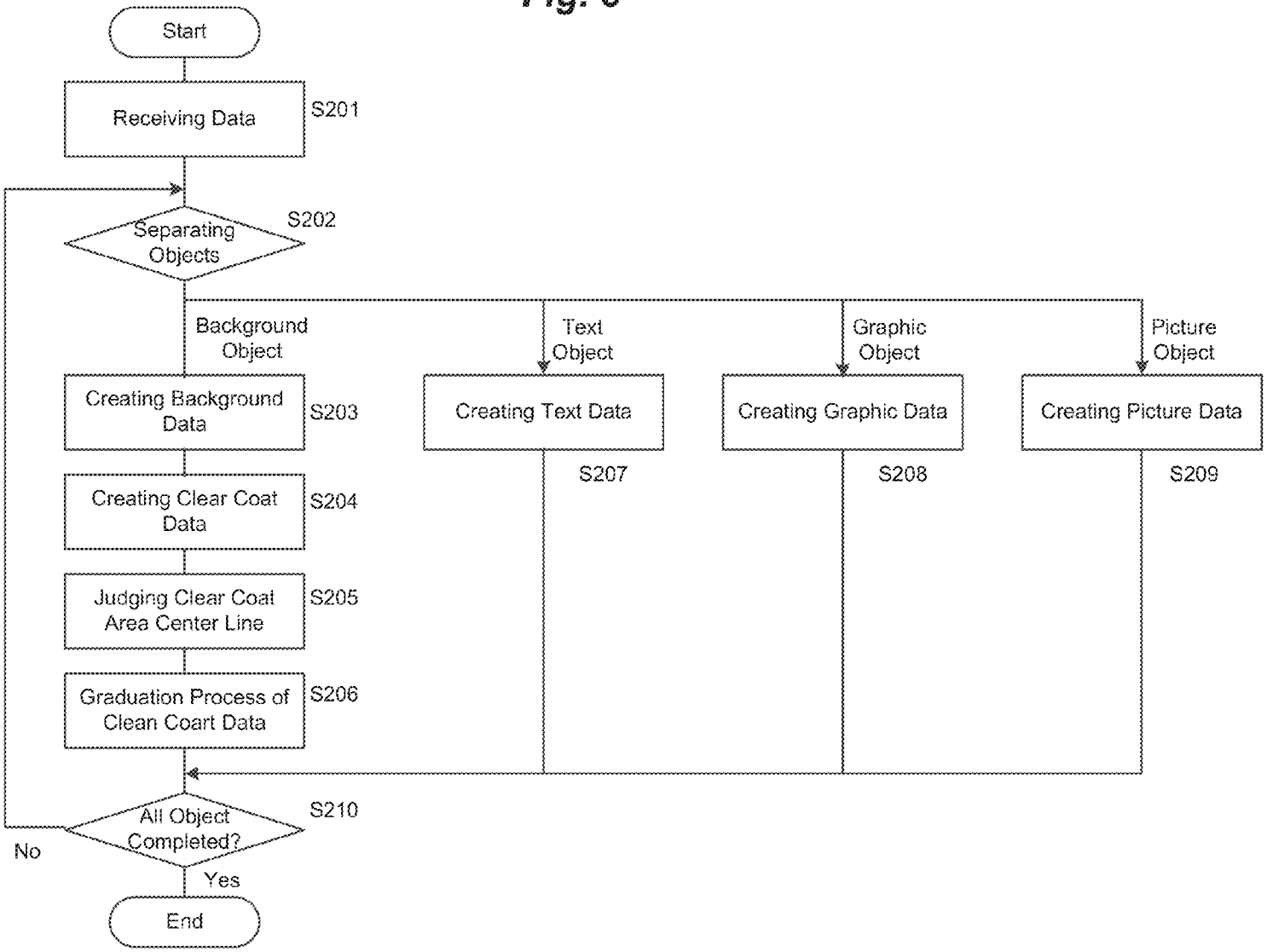
FIG. 8 is a flow diagram that illustrates a flow of a image data generation process according to the second embodiment.

Next, referring to FIG. 7, an image data generation process that the image data generation part 1102 of the printing apparatus 1100 performs is explained, following steps in a flow diagram of FIG. 8 that describes the image data generation process according to the second embodiment. Herein, the steps are indicated by S in the figure. S201-S203: As being the same as S101-103 in FIG. 3, the explanation is omitted. S204: The clear coat generation part 7108 performs a clear coat data creation process that determines a clear coat area that the clear coat agent is applied.

Generally, an entire drawing area of the background data created at S203 is set as a basic area, and an area that contains the basic area and an outside area that is a predetermined size of area directly outside the basic area is set as a printing area. However, in the present embodiment, the clear coat generation part 7108 can arbitrarily determine the size of the outside area with respect to the basic area, and creates clear coat data in which the area that contains the basic area and the outside area is set as one new clear coat agent drawing object. S205: The center judgment part 7119 performs a background data area center line Y coordinate calculation process to determine the center line part of the background data area.

Herein, the background data area center line Y coordinate calculation process that the center line judgment part 7119 performs is explained based on FIGS. 9A-9C. First, the center line judgment part 7119 obtains a bottom end Y1 coordinate 905 and an upper end Y2 coordinate 906 of background data with respect to the Y axis direction orthogonal to an arraying direction of the background illustrated by Arrow B in the figure and then obtains a Y center coordinate 904 by the Y center coordinate=(bottom end Y1 coordinate+upper end Y2 coordinate)/2. Herein, the arraying direction is a direction in which a plurality of background codes 902 are arrayed, which is for example a short-term direction of the pole-shaped background codes 902, that is in other words the X axis direction that is a direction that the widths of the background codes 902 change.

Note, information of the reading direction that is as the arraying direction of background is required to determine a Y coordinate of the center line. However, the information can be judged by identification information that is added by the data generation part 1002 of the host device 1000. Also, in the case that entire background data has a rectangular shape as a barcode, a longitudinal direction of the entire background data can be judged as a reading direction.

S206: The application amount determination part 7120 performs a gradation process of clear coat data. The application amount determination part 7120 performs the gradation process onto the drawing area of the clear coat data created at S204 from the center line 904 to the bottom end Y1 coordinate 905 and to the upper end Y2 906 of the background data obtained at S205 illustrated in FIG. 9; creates raster data of the clear coat agent, print information, and the like and stores in the display list of the print data memory part 1110; and the process moves into S210.

Herein, the gradation process is explained based on FIGS. 9A-9C. Note, there are various methods for the graduation process depending on the type and purpose of background data; however, one type of methods is explained using FIGS. 9A-9C in the present embodiment. FIG. 9A is a top view; FIG. 9B is a Y-Y cross view of FIG. 9A; and FIG. 9C is a X-X cross view of FIG. 9A. FIGS. 6A-6E are layout views of background codes as background data by a technology such as a conventional one dimensional barcode. On an upper surface of a medium 207, background codes 902 in a pole shape are arranged in the arraying direction of the background illustrated by Arrow B in the figure, and a clear coat agent 903 is applied so as to cover the background codes 902. Note, a center line 904*a* illustrated in FIG. 9B is a straight line parallel with the X axis that is the arraying direction of the background, and is a straight line that connects the centers of the background codes 902 in the Y axis direction in the respective X coordinates.

In the background code 902, unless there is damage in a straight line shaped area in the X axis direction, frailer in reading doesn't occur. Only on the area 904*b* in the vicinity of the center line 904*a* with respect to the Y axis direction of the background codes 902, a normal application amount of the clear coat agent is applied as maintaining a predetermined width in the direction orthogonal to the center line 904*a*. On the area other than the area 904*b*, an application amount of the clear coat agent that is smaller than the normal application amount is applied. In other words, the application amount determination part 7120 determines to reduce the application amount of the clear coat agent from the center line in the direction orthogonal to the arraying direction of the background to the end portion.

S207-S209: As being the same as S107-109 in FIG. 3, the explanation is omitted. S210: The control part 1111 judges whether analysis of all objects of the print data 1005 received from the host device 1000 via the communication part 1101 is completed; the process moves into S202 again and analysis of the print data 1005 is performed again when the control part 1111 judges that the analysis is not completed; and all process ends when the control part 1111 judges that all analysis is completed.

When image data is generated by the image data generation part 1102 of the printing apparatus 1100, the control part 1111 instructs the development unit control part 1113 of the printing part 1112 to perform image formation based on each image data stored in the display list in the print data memory part 1110. Upon receipt of the instruction, the development unit control part 1113 controls the K development part 1114, the Y development part 1115, the M development part 1116, the C development part 1117 and the CT development part 1118, and the K_LED head 1130, the Y_LED head 1131, the M_LED head 1132, the C_LED head 1133, and the CT_LED head 1134 such that image formation of a background data image is performed in the K development part 1114, image formation of a Y image of YMC image data is performed in the Y development part 1115, image formation of a M image of the YMC image data is performed in the M development part 1116, image formation of a C image of the YMC image data is performed in the C development part 1117, and image formation of a clear coat image of clear coat image data is performed in the CT development part 1118. The subsequent image formation operation of the printing apparatus 1100 is the same as that of the first embodiment, so explanation thereof is omitted.

When the image formation operation is completed by the printing apparatus 1100, as illustrated in FIGS. 9A-9C, the developer images are formed on the medium 207. As described above, because an image of the clear coat agent 903 is formed on an upper layer part of the background codes 902 with the CT developer 225 in the CT development unit 1118 so as to cover an image of the background codes 902 formed in the K development part 1114 with the K developer 213, the background codes 902 can be protected.

Also a YMC image formed with the Y developer 216 in the Y development part 1115, formed with the M developer 219 in the M development part 1116, and formed with the C developer 222 in the C development part 1117 might be on the image of the background codes 902 formed with the K developer 213. In that case, the YMC image is also covered by the clear coat agent 903 and can be protected.

In the present embodiment, a control operation of image formation whose feature is to adjust the application amount of clear coat agent generated in the CT development part 1118 with the CT developer 225 is performed. The application amount of clear coat agent is adjusted by adjusting light amount of the CT_LED head 1134. The application amount can be increased by increasing an exposure amount, and the application amount can be decreased by decreasing an exposure amount. Therefore, the application amount of clear coat agent can be adjusted. As described above, in the present embodiment, even for the background data (background pattern) read by lines, a portion that damage of the background data is severe and a portion that prevention of damage of the background data is necessary are covered with a normal application amount of clear coat agent, and a portion that damage of the background data rarely occurs and a portion that damage of the background data doesn't affect are covered with an application amount of clear coat agent that is smaller than the normal application amount. As the result, the consumption of the clear coat agent can be reduced.

As described above, in the second embodiment, even the background data is read by lines, a normal application amount of clear coat agent is applied on the center line in the direction orthogonal to the reading direction of the background codes as maintaining the predetermined width, and the application amount of the clear coat agent is reduced to be smaller than the normal application amount from the center line to the end portion. As a result, the same effect as the first embodiment can be obtained. Also, damages of the background data caused by the contact with the reading device and by passage of time, etc. can be reduced. Furthermore, in a portion that the normal application amount of clear coat agent is applied in a straight line shape, damage of the background data can be prevented, so that an effect that prevents the reading device from failing to read the background data due to damage of the background data can be obtained.

Third Embodiment

In the first embodiment and the second embodiment, embodiments that an image of the clear coat agent is formed onto the background data are shown. In the third embodiment, an embodiment that an image of the clear coat agent is formed depending on object types is explained.

Figure 10:
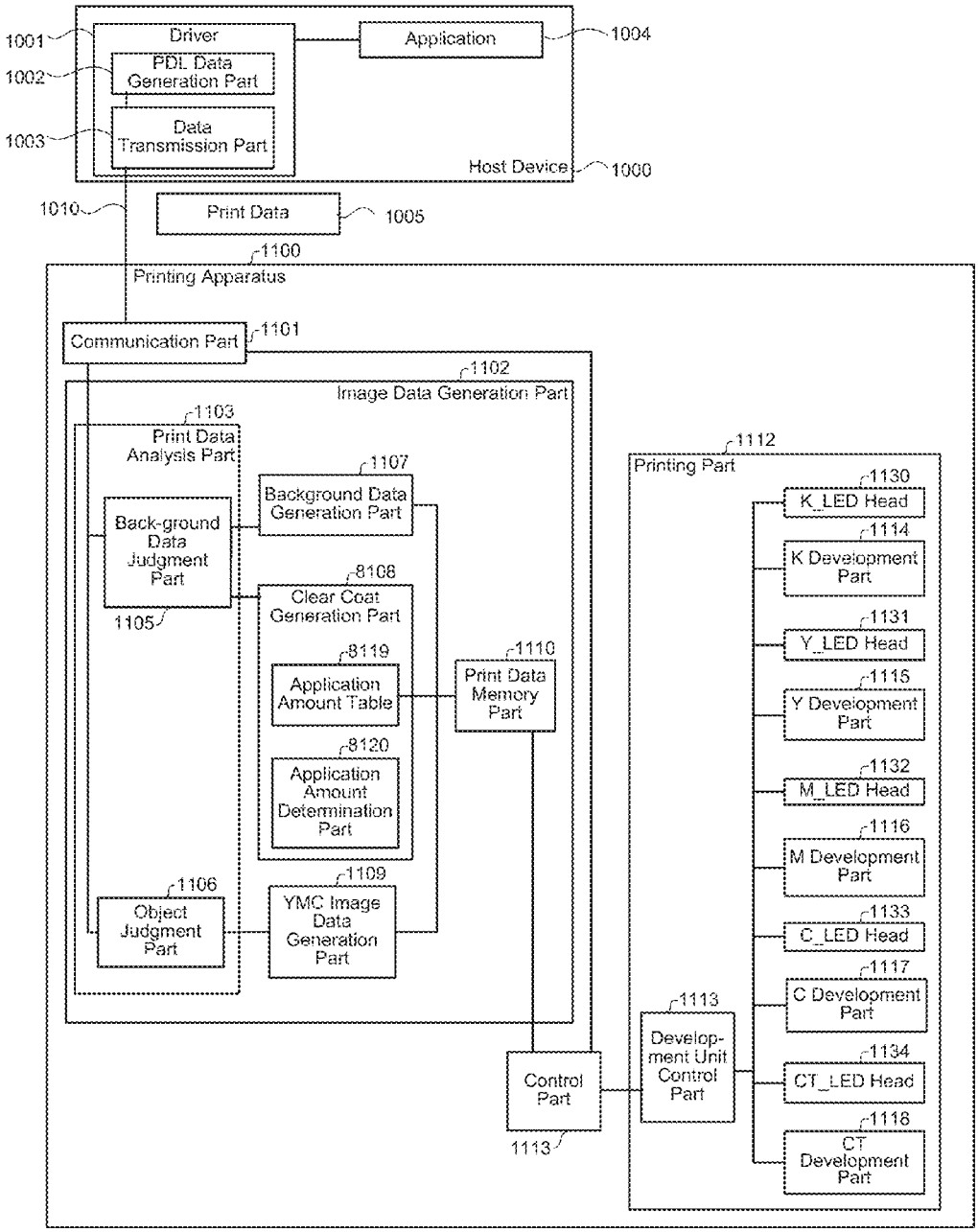
FIG. 10 is a block diagram that illustrates a configuration of a printing apparatus according to a third embodiment.

FIG. 10 is a block diagram that illustrates a configuration of a printing apparatus according to the third embodiment. Note, the same reference numbers are given to the parts that are the same as those of the above-described first and second embodiments, and explanation of those are omitted. In FIG. 10, the image data generation part 1102 includes the print data analysis part 1103, the background data generation part 1107, a clear coat generation part 8108, the YMC image data generation part 1109, and the print data memory part 1110.

The print data analysis part 1103 includes the background data judgment part 1105 and the object judgment part 1106, analyzes the print data 1005 that is the receipt data received via the communication part 1101, and forwards the image data to the conversion parts of the background data generation part 1107, the clear coat generation part 8108, and the YMC image data generation part 1109.

The background data judgment part 1105 selects only data that contains only background from the receipt data received via the communication part 1101 and analyses it, and then forwards the analyzed data to the background data generation part 1107 and the clear coat generation part 8108. The object judgment part 1106 selects object data other than background from the receipt data received via the communication part 1101 and analyses it, and then forwards the analyzed data to the YMC image data generation part 1109 and the clear coat generation part 8108.

The background data generation part 1107 performs an edit and expand process based on data judged by the background data judgment part 1105, and generates print information of the background image data. The clear coat generation part 8108 includes an application amount determination part 8120 as a clear coat agent application amount determination part and an application amount table 8121 that is a table that memorizes the application amount of clear coat agent by object types. The clear coat generation part 8108 determines an area that a clear coat agent is applied based on data judged by the background data judgment part 1105 and the object judgment part 1106, and the application amount determination part 8120 determines an application amount of the clear coat agent applied to the medium 207. The application amount determination part 8120 determines the application amount depending on the object type referring to the application amount table 8121. The YMC image data generation part 1109 performs an edit and expand process based on data judged by the object judgment part 1106, and generates printing information of texts, graphics, and pictures.

The print data memory part 1110 memorizes the picture data and print information as image data, the picture data and print information being generated by the background data generation part 1107, the clear coat generation part 8108, and the YMC image data generation part 1109.

A function of the above-described configuration is explained. At first, a function of the image forming system is explained using FIG. 10. In response to a print start instruction by an user operation, the application 1004 in the host device 1000 generates a spool file based on the created color image picture data and background image picture data and outputs the generated spool file to the driver 1001. Herein, the spool file is intermediate data of print data that the application 1004 sends to the driver 1001.

In response to the input of the spool file output from the application 1004, the PDL data generation part 1002 of the driver 1001 generates PDL data described in a program language to instruct the printing apparatus 1100 to draw. Also, the PDL data generation part 1002 generates print job data that includes background image data and color print data. Herein, an identifier is given to the print job data to identify the color print data and the background image data. To the background image data, an identifier to identify the reading direction is given. The data transmission part 1003 transmits the print data 1005 generated by the PDL data generation part based on the output data 602 to the communication part 1101 of the printing apparatus 1100.

Figure 11:
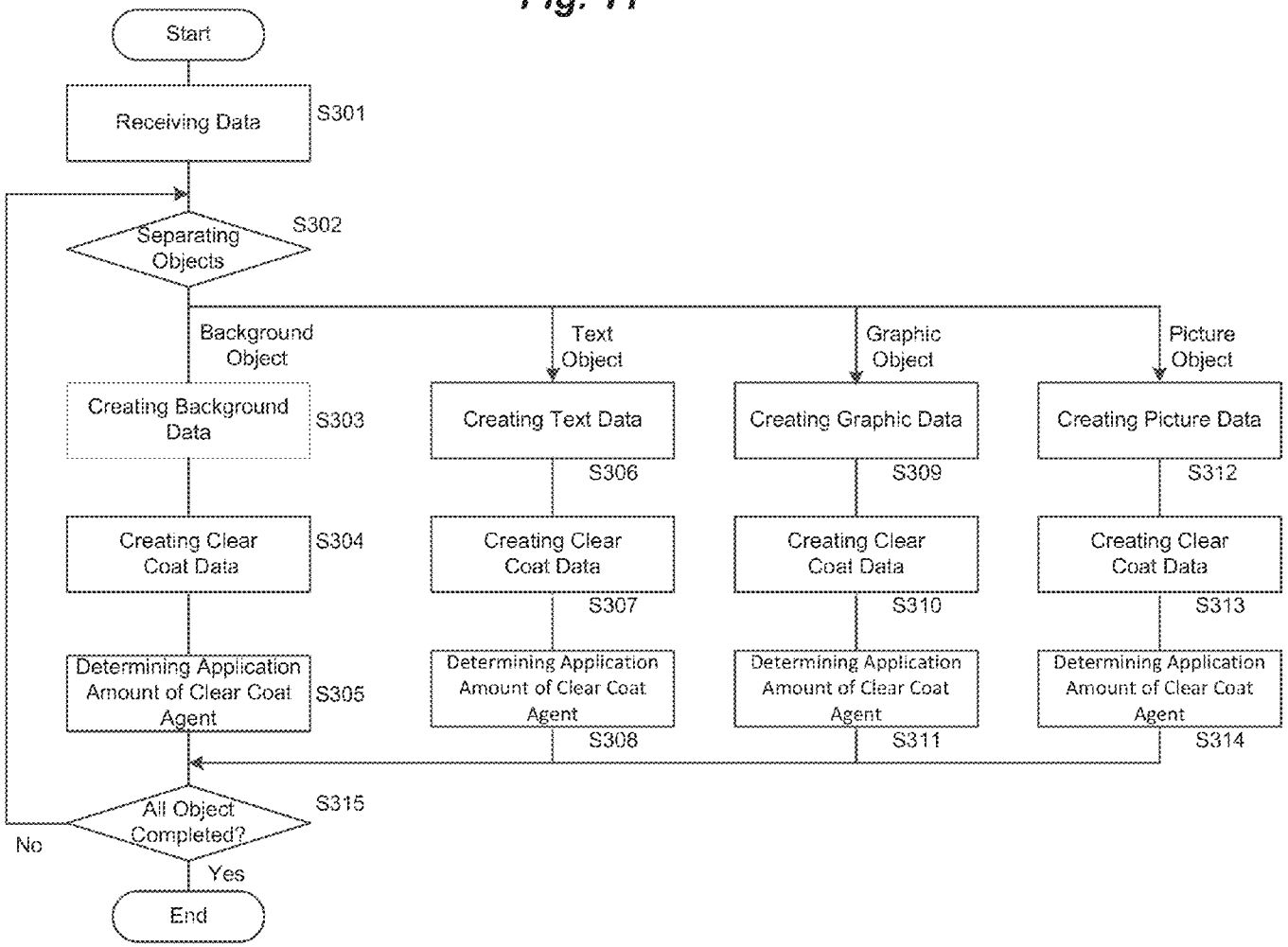
FIG. 11 is a flow diagram that illustrates a flow of a image data generation process according to the third embodiment.

Next, referring to FIG. 11, an image data generation process that the image data generation part 1102 of the printing apparatus 1100 performs is explained, following steps in a flow diagram of FIG. 10 that describes the image data generation process according to the second embodiment. Herein, the steps are indicated by S in the figure. S301-S304: As being the same as S201-204 in FIG. 8, the explanation is omitted. S305: The application amount determination part 8120 determines the application amount of clear coat agent for the background data as referring to data contained in the application amount table 8121 in the clear coat generation part 8108.

S306: The YMC image data generation part 1109 creates raster data and printing information of texts based on a separated object and stores in the display list of the print data memory part 1110; and the process moves into S307. S307: The clear coat generation part 8108 determines a clear coat area to add the clear coat agent and performs a clear coat data generation process. S308: The application amount determination part 8120 determines the application amount of clear coat agent of text data as referring to data contained in the application amount table 8121 in the clear coat generation part 8108.

S309: The YMC image data generation part 1109 creates raster data and printing information of graphics based on a separated object and stores in the display list of the print data memory part 1110; and the process moves into S310. S310: The clear coat generation part 8108 determines a clear coat area to add the clear coat agent and performs a clear coat data generation process. S311: The application amount determination part 8120 determines the application amount of clear coat agent of graphic data as referring to data contained in the application amount table 8121 in the clear coat generation part 8108.

S312: The YMC image data generation part 1109 creates raster data and printing information of pictures based on a separated object and stores in the display list of the print data memory part 1110; and the process moves into S313. S313: The clear coat generation part 8108 determines a clear coat area to add the clear coat agent and performs a clear coat data generation process. S314: The application amount determination part 8120 determines the application amount of clear coat agent of picture data as referring to data contained in the application amount table 8121 in the clear coat generation part 8108.

S315: The control part 1111 judges whether analysis of all objects of the print data 1005 received from the host device 1000 via the communication part 1101 is completed; the process moves into S302 again and analysis of the print data 1005 is performed again when the control part 1111 judges that the analysis is not completed; and all process ends when the control part 1111 judges that all analysis is completed.

FIG. 12 shows an example of the application amount table 8121. FIGS. 13A-13D are sectional schematic views of printed sheets on which clear coat layers are formed based on FIG. 12.

The application amount of clear coat agent is set to be smaller for data that necessity to protect is low because the frequency of chance to be contacted by a person is small. The application amount of clear coat agent is set to be larger for data that necessity to protect is high. In the present embodiment, in the order of background, picture data, graphic data, and text data, the application amount of clear coat agent is set to be smaller. However, the large/small correlation of the application amount is not limited to the correlation of the present embodiment.

In the present embodiment, the clear coat generation part 8108 includes the application amount table 8121 as default. However, a configuration that setting thereof can be performed by a user is also applicable. Also, it is possible to set not to apply the clear coat agent to objects that does not require application of the clear coat agent. Note, also to an image that doesn't contain background data, the present embodiment that the application amount of clear coat agent is determined depending on object types is applicable. Furthermore, it is also possible to perform the gradation process described in the first and second embodiments in the process of applying the clear coat agent to each object.

As illustrated in FIGS. 13A to 13D, the thicknesses of the clear coat layer may be increased in an order that is text, graphic, picture and background.

Note, in the first and second embodiments, a description that the printing apparatus is an electrographic system printer is given. However, it is not limited to that, and printers, photocopiers, and facsimile machine of an electrographic system, an ink jet system, or a thermal transfer system that apply the clear coat agent are applicable. Also, in the first and second embodiments, a description that the printing apparatus is a color printer is given, however, it is not limited to that. A monochromatic printer may also be applicable.

In the application, there are two different terms regarding features of the background. One is a central part, the other is a center portion. These definitions are described here.

(1) Central Part

The central part is defined as an intersectional point between center lines of X and Y axes where a background is represented with X and Y axes. For example, in FIG. 5, the central part is determined at an intersectional point CP2 between X center coordinate 501 and Y center coordinate 504. These center coordinates may be determined as lines passing on a middle of each of the axes. Also, these center coordinates may be determined as lines passing on a gravity center of the area of the background pattern.

(2) Center Portion

The center portion is defined as a region where the clear coat layer is thick most. In regular embodiments, the above central part often corresponds to the center portion. The center portion does not necessarily have the thickest clear coat layer. In this means, the center portion is not necessarily the central part. Further, the center portion is not always a point or dot. When a thick region of the clear coat layer extends along X and/or Y axes, the thick region as a whole can be defined as a center portion.

What is claimed is:

1. An image forming apparatus, comprising:

an image forming part that forms an image on a print medium with a color colorant;

a clear coat agent application part that applies a clear coat agent to the print medium passed through the image forming part;

a clear coat agent application amount determination part that determines an application amount of the clear coat agent; and a background formation part that forms a background to the print medium, wherein the clear coat agent application amount determination part determines an application amount of the clear coat agent at an end portion of the background to be smaller than an application amount thereof at a center portion of the background.

2. The image forming apparatus according to claim 1, wherein the clear coat agent application amount determination part determines to reduce the application amount of the clear coat agent from a central part of the background to an outside.

3. The image forming apparatus according to claim 2, wherein the clear coat agent application amount determination part determines to gradually reduce the application amount of the clear coat agent from the central part of the background to the outside.

4. The image forming apparatus according to claim 1, wherein the clear coat agent application amount determination part determines to reduce the application amount of the clear coat agent so as to form a curved surface in a vicinity of the end portion of the background.

5. The image forming apparatus according to claim 1, wherein the clear coat agent application amount determination part determines to stepwisely reduce the application amount of the clear coat agent from the central part of the background to the outside.

6. The image forming apparatus according to claim 1, wherein the clear coat agent application amount determination part determines to reduce the application amount of the clear coat agent from a center line in a direction orthogonal to an arraying direction of the background to the end portion.

7. The image forming apparatus according to claim 1, further comprising:

a print data analysis part that judges a type and an area of an object of print data that are configured with a plurality of objects, wherein the clear coat agent application amount determination part determines the application amount of the clear coat agent depending on the type of the objects.

8. The image forming apparatus according to claim 1, further comprising:

a print data analysis part that judges a type and an area of an object of print data that are configured with a plurality of objects, wherein the clear coat agent application amount determination part determines the application amount of the clear coat agent depending on the area of the objects.

9. The image forming apparatus according to claim 7, further comprising:

an application amount table in which an application amount of the clear coat agent for each of the objects is written.

10. The image forming apparatus according to claim 9, wherein the clear coat agent application amount determination part chooses the application amount of the clear coat agent from the application amount table.

11. The image forming apparatus according to claim 7, wherein the objects are comprised from elements selected from a group of a text, a graphic, a picture and a background.

* * * * *